US008128483B2

(12) United States Patent
Vann et al.

(10) Patent No.: US 8,128,483 B2
(45) Date of Patent: Mar. 6, 2012

(54) GAMING MACHINE WITH SYNCHRONIZED BEZEL LIGHTS

(75) Inventors: Jamie W. Vann, Chicago, IL (US); Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 12/741,606

(22) PCT Filed: Nov. 7, 2008

(86) PCT No.: PCT/US2008/012553

§ 371 (c)(1),
(2), (4) Date: May 6, 2010

(87) PCT Pub. No.: WO2009/061457

PCT Pub. Date: May 14, 2009

(65) Prior Publication Data

US 2011/0092268 A1 Apr. 21, 2011

Related U.S. Application Data

(60) Provisional application No. 61/002,717, filed on Nov. 9, 2007.

(51) Int. Cl.
*A63F 9/24* (2006.01)

(52) U.S. Cl. ..... 463/20; 463/16; 463/31

(58) Field of Classification Search ..... 463/16, 463/17, 25, 29–31, 20
See application file for complete search history.

(56) References Cited

U.S. PATENT DOCUMENTS

| | | | | |
|---|---|---|---|---|
| 5,833,537 | A * | 11/1998 | Barrie | 463/21 |
| 6,394,900 | B1 | 5/2002 | McGlone et al. | 463/20 |
| 6,786,818 | B1 * | 9/2004 | Rothschild et al. | 463/20 |
| 6,869,360 | B2 * | 3/2005 | Marks et al. | 463/25 |
| 2002/0137560 | A1 | 9/2002 | DeMar et al. | 463/16 |
| 2003/0109304 | A1 * | 6/2003 | Gauselmann | 463/30 |
| 2004/0072619 | A1 * | 4/2004 | Brosnan et al. | 463/42 |
| 2006/0068873 | A1 | 3/2006 | Gomez | 463/16 |
| 2006/0068894 | A1 | 3/2006 | Wadleigh et al. | 463/20 |

OTHER PUBLICATIONS

PCT International Search Report for International Application No. PCT/US2008/012553 dated Jan. 15, 2009 (2 pages).
PCT International Written Opinion for International Application No. PCT/US2008/012553 dated Jan. 15, 2009 (5 pages).

* cited by examiner

*Primary Examiner* — Omkar Deodhar
(74) *Attorney, Agent, or Firm* — Nixon Peabody LLP

(57) ABSTRACT

A gaming system for conducting a wagering game includes a wager input device, and a display for displaying a wagering game. The wagering game includes at least one moveable game element, at least one bezel light positioned proximate the display, and a controller operative to activate the bezel light in coordination with movement of the at least one moveable game element. The gaming system may have a plurality of bezel lights respectively positioned proximate the display, and the controller may be operative to activate the bezel lights singly or in combination in coordination with movement of the at least one moveable game element.

18 Claims, 9 Drawing Sheets

GAMING MACHINE WITH SYNCHRONIZED BEZEL LIGHTS

CROSS REFERENCE TO RELATED APPLICATIONS

This application is a U.S. national stage of International Application No. PCT/US2008/012553, titled "Gaming Machine With Synchronized Bezel Lights" and filed on Nov. 7, 2008, which claims priority to U.S. Provisional Patent Application Ser. No. 61/002,717, titled "Gaming Machine With Synchronized Bezel Lights" and filed on Nov. 9, 2007, each of which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system with synchronized bezel lights.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays or audio, or both. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

The present invention is directed toward a gaming system having synchronized bezel lighting.

SUMMARY OF THE INVENTION

According to one aspect of the present method and apparatus, a gaming system for conducting a wagering game includes a display for displaying a wagering game, the wagering game including at least one moveable wagering game outcome. At least one bezel light is positioned proximate the display, and a controller is operative to activate the bezel light in coordination with movement of the at least one moveable wagering game outcome.

According to another aspect of the present method and apparatus, a method of operating a wagering game comprises receiving at least one wager from at least a first player and displaying on a first display a primary wagering game in response to receiving the at least one wager, the primary wagering game including at least one moveable game element. The method further comprises activating a bezel light in coordination with movement of the at least one moveable game element, the bezel light positioned proximate the first display.

According to another aspect of the present method and apparatus, a gaming system comprises a wager input device and a display for displaying a primary wagering game, the primary wagering game including at least one substantially fixed symbol, at least one moveable symbol, and at least one award symbol. The system further comprises a plurality of bezel lights arranged in sections and respectively positioned proximate the display, and a controller operative to selectively activate the bezel lights in at least one predetermined pattern in response to the at least one moveable symbol intersecting one of the at least one fixed symbol and the at least one award symbol.

Additional aspects of the present method and apparatus will be apparent to those of ordinary skill in the art in view of the detailed description of various embodiments, which is made with reference to the drawings, a brief description of which is provided below.

DETAILED DESCRIPTION

Figure 1A:
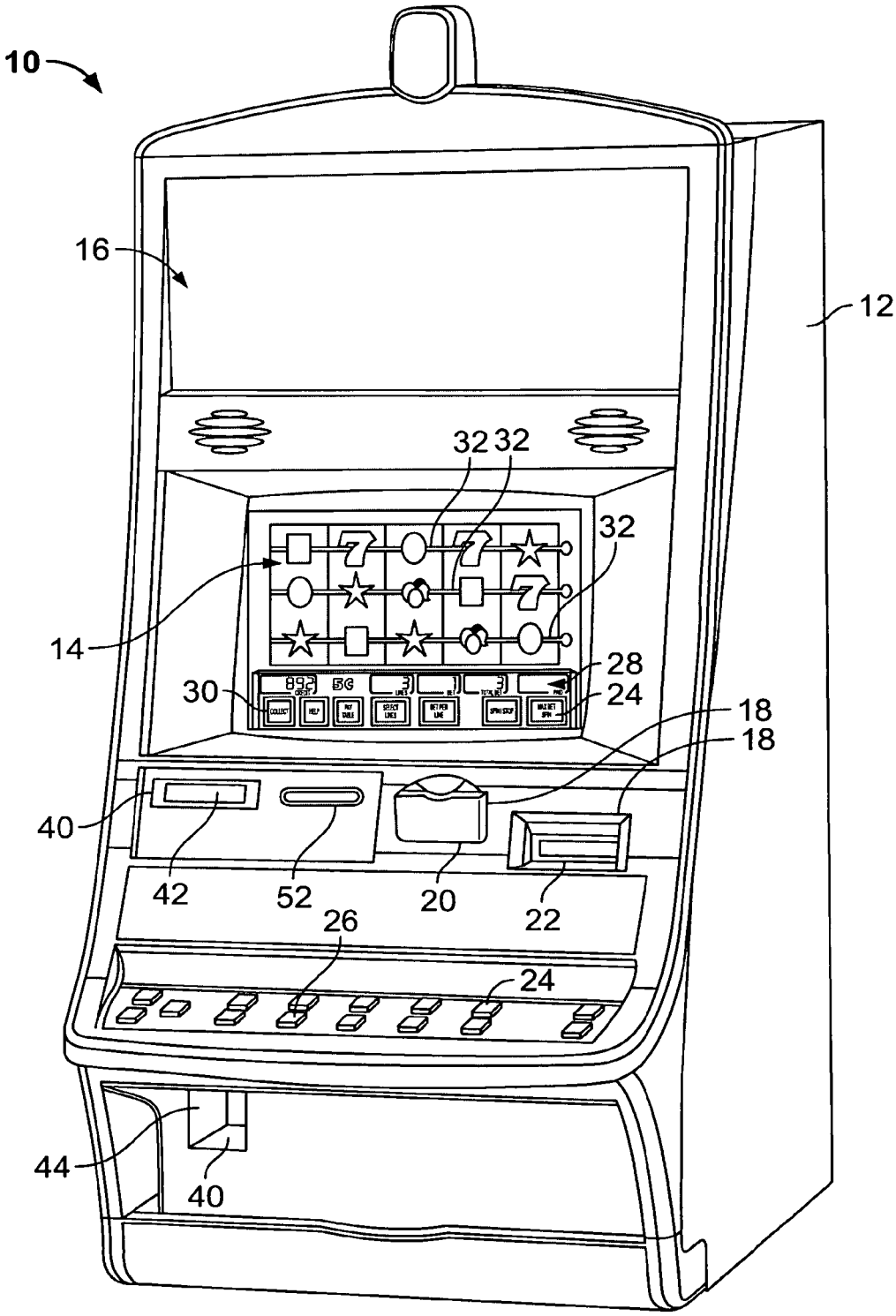
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a display 14 for displaying information about the basic wagering game. The display 14 can also display information about a bonus wagering game and a progressive wagering game. The gaming machine 10 may also include a secondary display 16 for displaying game events, game outcomes, or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency, credits, or both that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the display 14 or secondary display 16, or both. The touch screen 28 contains soft touch keys 30 denoted by graphics on the underlying display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the display 14. The display 14 can also display the bonus game associated with the basic wagering game. The display 14 of the gaming machine 10 may include a number of mechanical reels to display the outcome in visual association with at least one payline 32. Alternatively, the display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the display 14 includes the touch screen 28 overlaying the entire display (or a portion thereof) to allow players to make game-related selections. In the illustrated embodiment, the gaming machine 10 is an "upright" version in which the display 14 is oriented vertically relative to the player. Alternatively, the gaming machine may be a "slant-top" version in which the display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
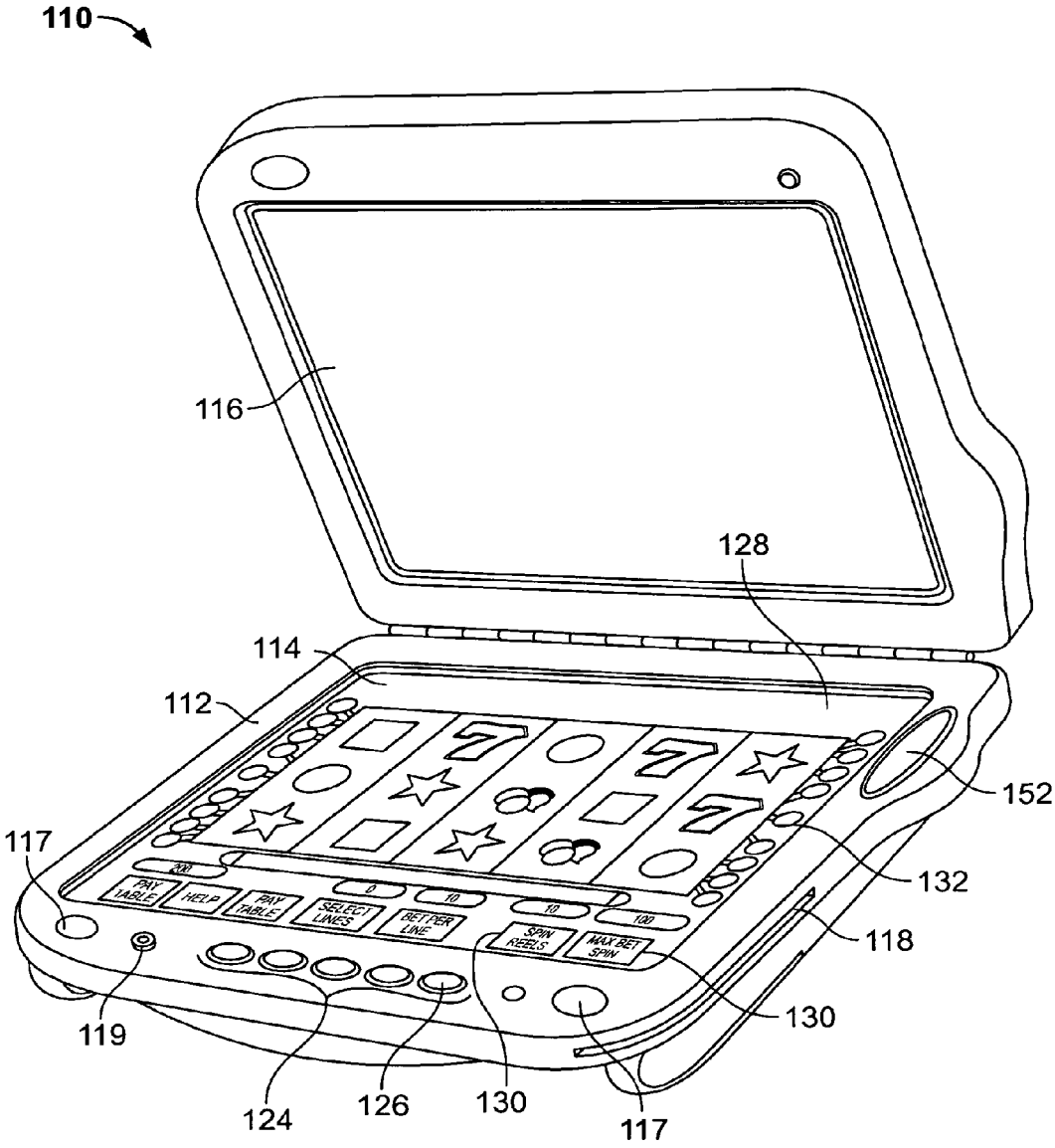
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the display 114. The optional secondary display 116 may be fixed, movable, or detachable/attachable relative to the display 114. Either the display 114, or the secondary display 116, or both may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., display 114 or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a display 114 or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the display 114. The display 114 can also display the bonus game associated with the basic wagering game. The display 114 preferably includes a number of mechanical reels to display the outcome in visual association with at least one payline. Alternatively, the display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the display 114 may vary from, for example, about a 2-3" display to a 15" or 17" display. In at least some aspects, the display 114 is a 7"-10" display. As the weight of or power requirements of such displays decreases with improvements in technology, it is envisaged that the size of the display may be increased. Optionally, coatings or removable films or sheets may be applied to the display to provide desired characteristics (e.g., anti-scratch, anti-glare, bacterially-resistant and anti-microbial films, etc.). In at least some embodiments, the display 114, the secondary display 116, or both may have a 16:9 aspect ratio or other aspect ratio (e.g., 4:3). The display 114 and the secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
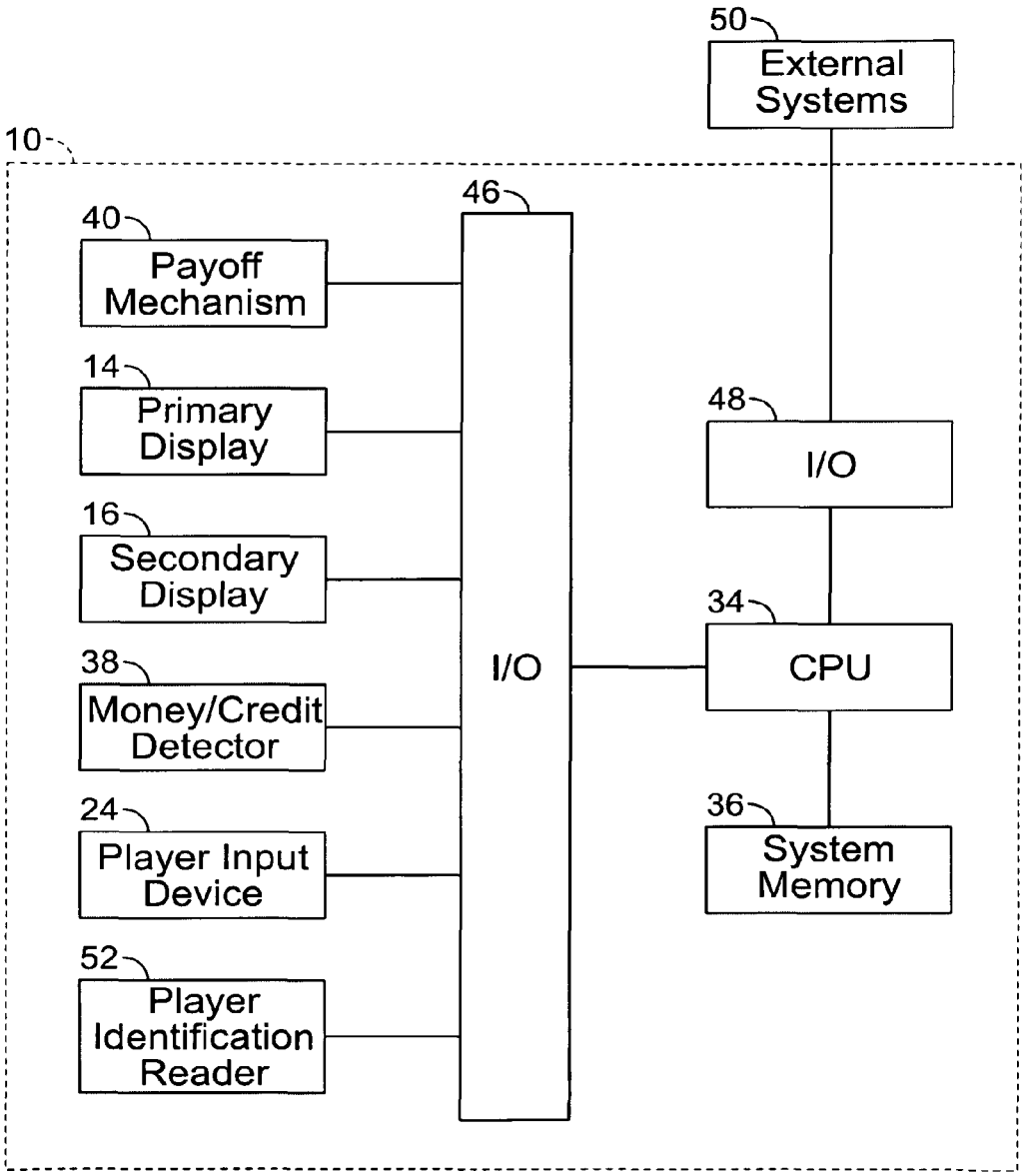
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, or firmware that may be disposed or resident inside or outside of the gaming machine 10 that may communicate with a control the transfer of data between the gaming machine 10 and a bus, another computer, processor, or device, a service or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
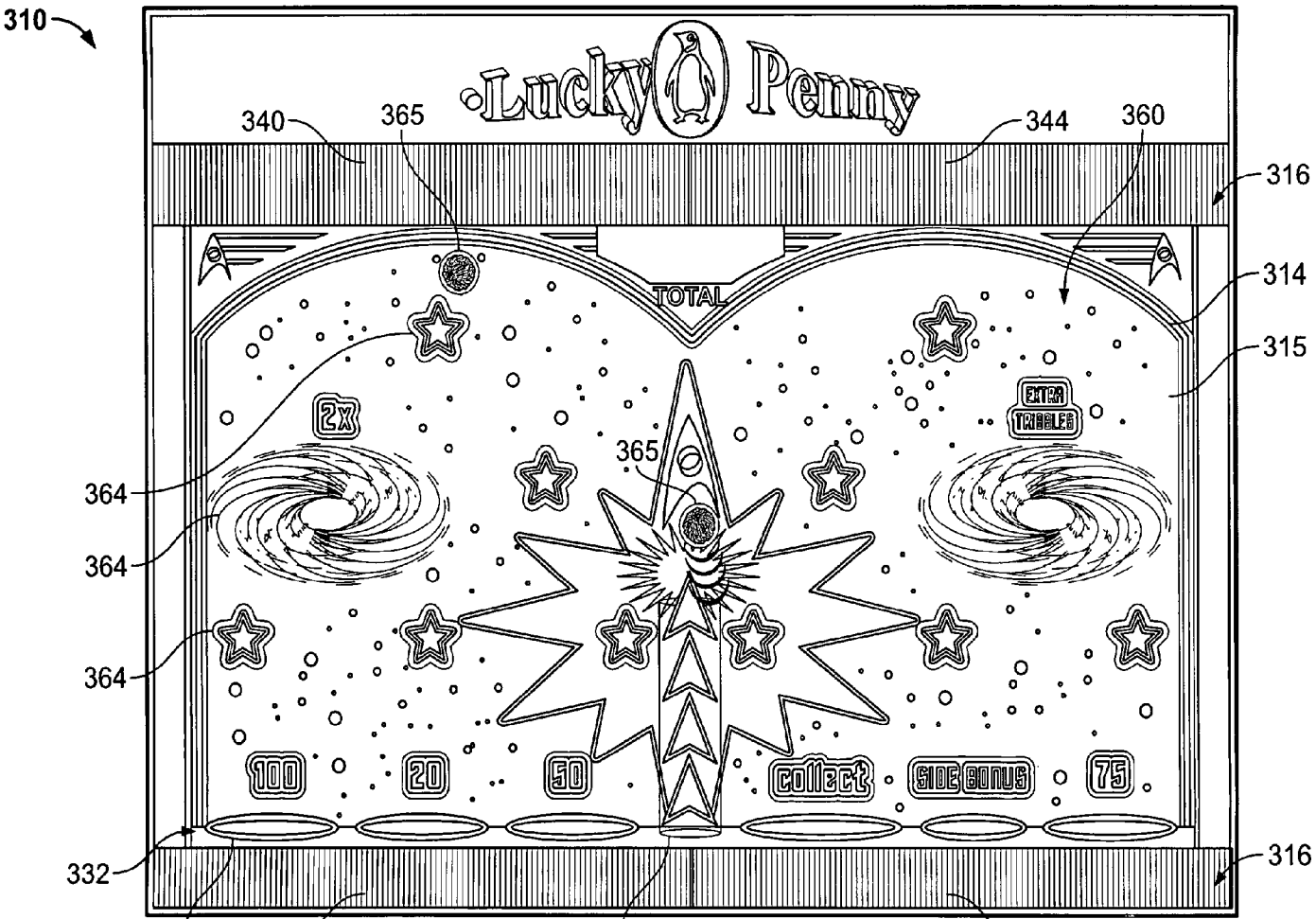
FIG. 3 is a view of a gaming system according to the present method and apparatus with a display and synchronized bezel lights.

Turning now to FIG. 3, a display 314 of a gaming device 310 of a gaming system is shown. The gaming system may be a pinball type game, a slot type game, a poker type game, etc. The display 314 may be any form of display such as those described herein with reference to the free standing and handheld gaming devices of FIGS. 1*a* and 1*b*. The display 314 may include a playing field 315 of a primary wagering game 360. In the embodiment shown, the primary wagering game 360 is a pinball type game having at least one substantially fixed symbol 364, at least one moveable symbol 365, and at least one award symbol 333. The term "moveable symbol" may also be referred to as a "moveable game element", or in more general terms as a "wagering game outcome", which may be displayed in coordination with the bezel lights. The symbols 364, 365, 333 may include any variety of graphical symbols, elements, or representations, including symbols which are associated with one or more themes of the gaming machine or system. Fixed symbols 364 may also be referred to as targets. As described herein the moveable symbols 365 colliding with, interacting with and intersecting fixed symbols 364 and landing on, in or proximate the award symbols 333 are evaluated for winning combinations.

The playing field 315 may further include a start region 317 for the moveable symbols 365. In this embodiment the moveable symbols 365 are shot up from the start region 317 into the playing field 315, and eventually land on a respective award symbol 333 in a bottom area 332 of the playing field 315. When a moveable symbol 365 lands on a respective award symbol 333 a primary award is awarded in accordance with a pay table of the gaming. As seen in FIG. 3, the playing field 315 also displays the primary awards associated with each award symbol 333 in a position proximate to and directly above each award symbol 333.

The gaming device 310 further includes one or more bezel lights 316. The bezel lights 316 may be part of or a subset of the display 314, or may be separate from the display 314 and positioned proximate the display 314. The bezel lights 316 may have a plurality of sections in an operational relationship with the symbols 364, 365 of the display 314. The sections of the bezel lights 316 may have many different forms, such as predetermined geometric areas, symbols, text, etc. The bezel lights 316 of the gaming device 310 may further comprise lights around the playing field 315 that are divided into the sections. In the depicted embodiment the lights or sections are divided into four quadrants 340, 342, 344, 346. When activated the four quadrants 340, 342, 344, 346 may be flashed at predetermined rates, turned on and off individually or in combination, or activated in other predetermined patterns. In an embodiment, the four sections or quadrants 340, 342, 344, 346 are individual lights that are separately activated. In an alternative embodiment, the four quadrants 340, 342, 344, 346 comprise subsections of a single light or lighting element, wherein the sections are separately controllable. In FIG. 3, all four quadrants 340, 342, 344, 346 of the bezel light 316 are shown in an "OFF" or non-illuminated state (where vertical hatch marks signify "OFF").

The primary display 314 shown in the FIGURES may, in alternative embodiments, be accompanied by other displays on the gaming device 310. For example, the primary display 314 and wagering game 360 displayed thereon may be a secondary or bonus game which is activated in response to a triggering event in another wagering game, such as a basic wagering game. For example, a second display of the gaming device 310 may display a slot game in which certain resulting combinations of symbols trigger activation of the primary wagering game 360 and playing field 315 on the primary display 314. Moreover, in yet other alternative embodiments, the playing field 315 may be displayed on a handheld device, on a community display, or on any other appropriate display in communication with the gaming device 310 and system.

The depicted embodiments according to the present method and apparatus may be applied to a variety of game settings and game rules. The setting for the present depicted game is a pinball-like event where moveable symbols 365 travel around an obstacle-filled playing field 315 until they land in award symbols 333 at the bottom of the screen. As the moveable symbols, such as moveable symbol 365, travel around the playing field 315, they may bounce off fixed symbols, such as fixed symbol 364 which may be a bumper or target. Each collision may trigger the sound of a pinball bumper, the flash of the onscreen target, and also a synchronized flash of, for example, LED light banks in the quadrants 340, 342, 344, 346 that are adjacent the playing field 315.

Figure 4:
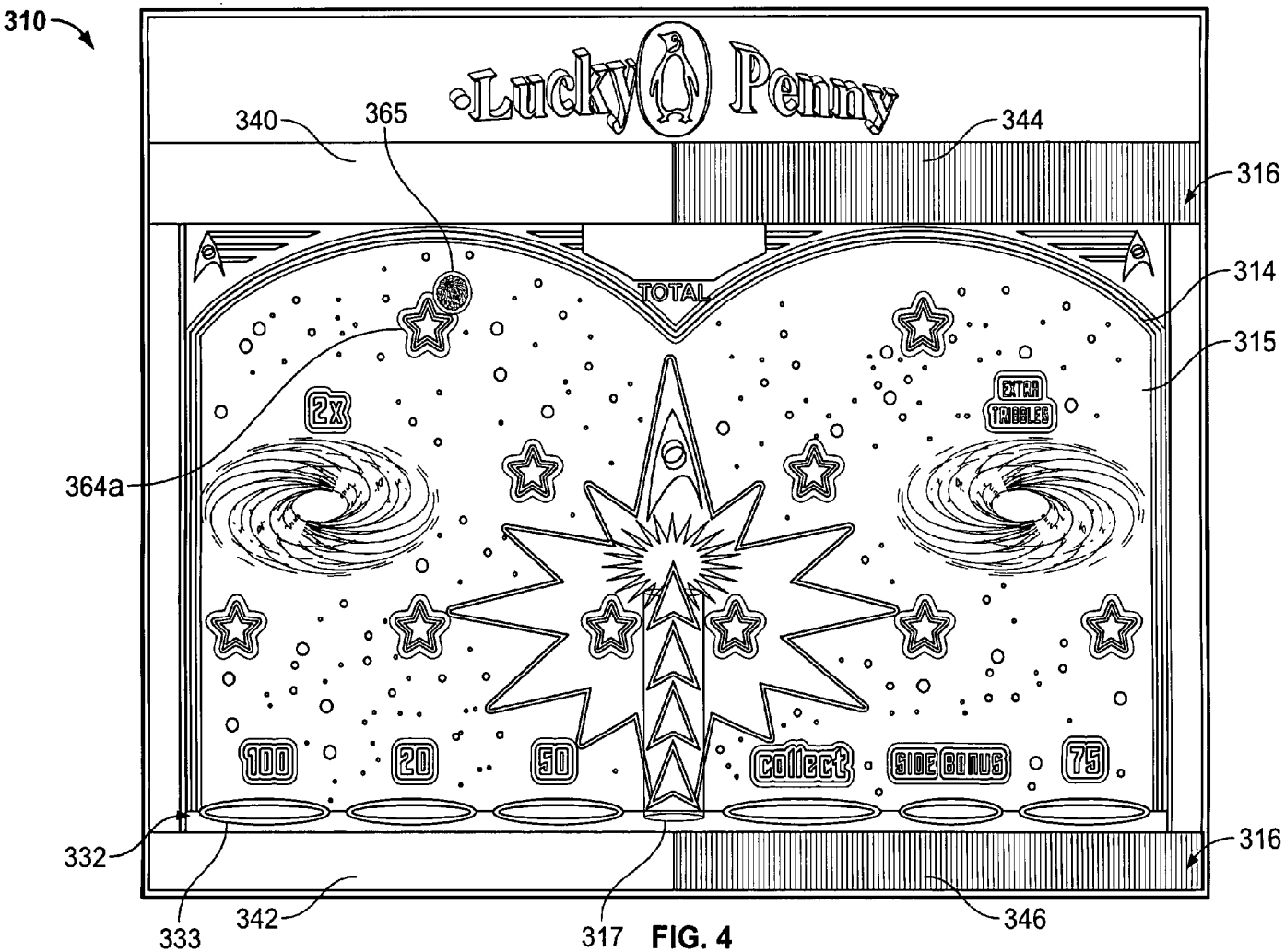
FIG. 4 is a view of the gaming system of FIG. 3, in which a beginning of play is depicted.

Turning to FIG. 4, a play of the wagering game 360 is displayed. During play of the game, a first moveable symbol 365 is ejected from the starting position 317 and into the playing field 315, as is customary in pinball type games. The moveable symbol 365 begins to move about the playing field 315 and encounters other elements therein. As depicted the moveable symbol 365 may collide with or intersect a fixed symbol **364*a*, and the gaming device 310 may store the occurrence of this event. The moveable symbol 365 may be held at the location of the fixed symbol 364*a* pending a further event, may be transferred to another location, or may be allowed to continue on its way. In this embodiment, as seen in FIG. 4, the fixed symbol 364*a* with which the moveable symbol 365 collides is on a left side of the playing field 315 of the gaming device 310. The moveable symbol 365 may bounce off the fixed symbol 364*a* and in response the first and second quadrants 340, 342 of bezel lights on the left side of the playing field 315 are flashed. Thus, as seen in FIG. 4, the first and second quadrants 340, 342 are turned "ON" or illuminated (no vertical hatch marks) while the third and fourth quadrants 344, 346 remain "OFF" or non-illuminated (vertical hatch marks present). In this way, the first and second quadrants 340, 342 of the bezel light 316 are controlled so as to be turned "ON" in coordination with the collision of the moveable symbol 365 with the fixed symbol 364*a* on the left side of the playing field 315. This directs the player's attention to the left side of the playing field 315** so as to observe the relevant collision.

Figure 5:
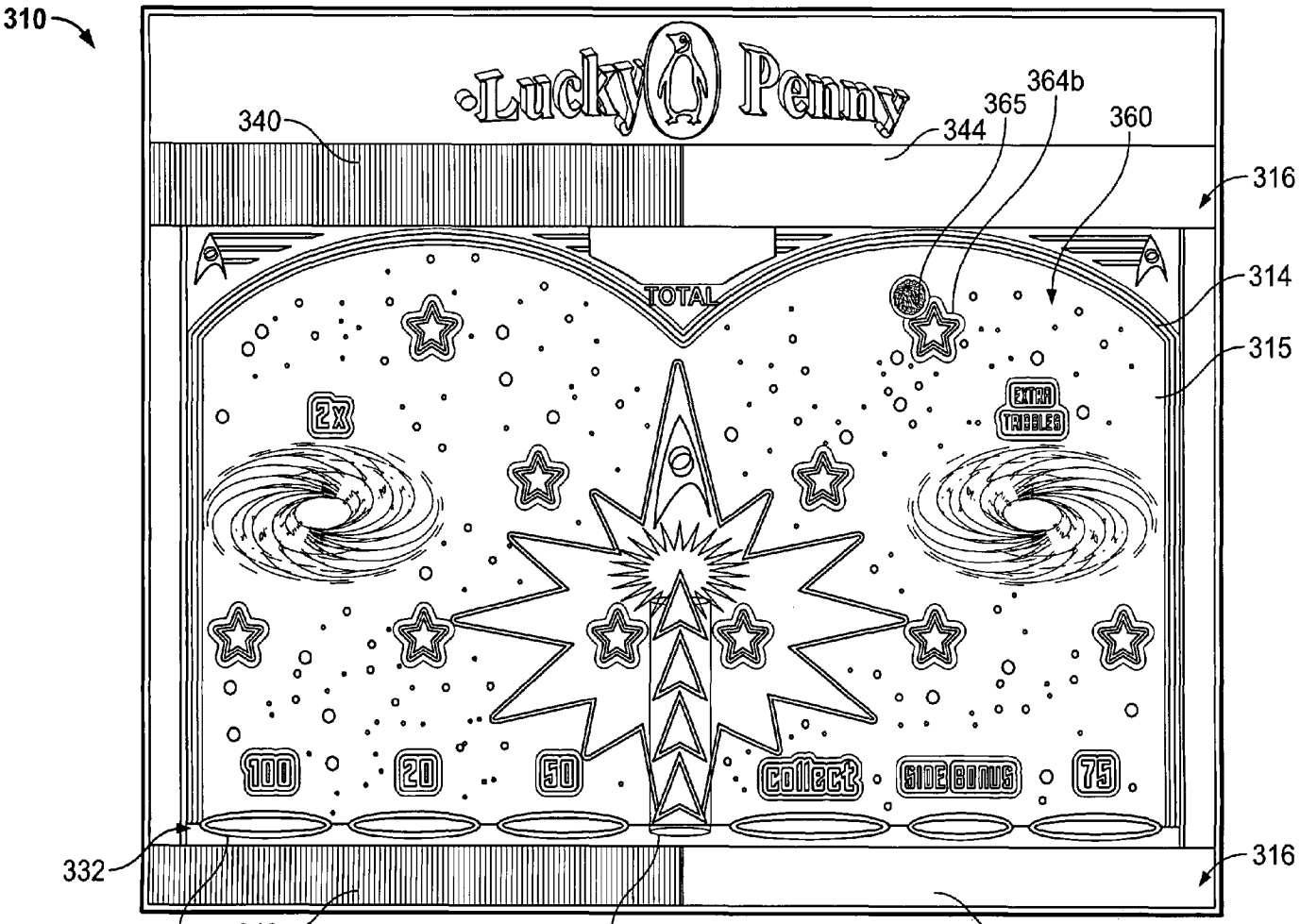
FIG. 5 is a view of the gaming system of FIG. 3, in which a continuation of play is depicted.

Turning to FIG. 5, a further play of the wagering game 360 is displayed. The moveable symbol 365 now collides with or intersects a fixed symbol **364*b* on the right side of the playing field 315, and the gaming device 310 may store the occurrence of this event. The moveable symbol 365 may be held at the location of the fixed symbol 364*b* pending a further event, may be transferred to another location, or may be allowed to continue on its way. In this embodiment the fixed symbol 364*b* is on the right side of the playing field 315 of the gaming device 310. The moveable symbol 365 may bounce off the fixed symbol 364*b* and in response the third and fourth quadrants 344, 346 on the right side of the playing field 315 are flashed "ON." Thus, as seen in FIG. 5, the first and second quadrants 340, 342 are now turned "OFF" or non-illuminated (vertical hatch marks present) while the third and fourth quadrants 344, 346 are activated or turned "ON" or illuminated (no vertical hatch marks). In this way, the third and fourth quadrants 344, 346 of the bezel light 316 are controlled so as to be turned "ON" in coordination with the collision of the moveable symbol 365 with the fixed symbol 364*b* on the right side of the playing field 315. This directs the player's attention to the right side of the playing field 315** so as to observe the relevant collision.

Figure 6:
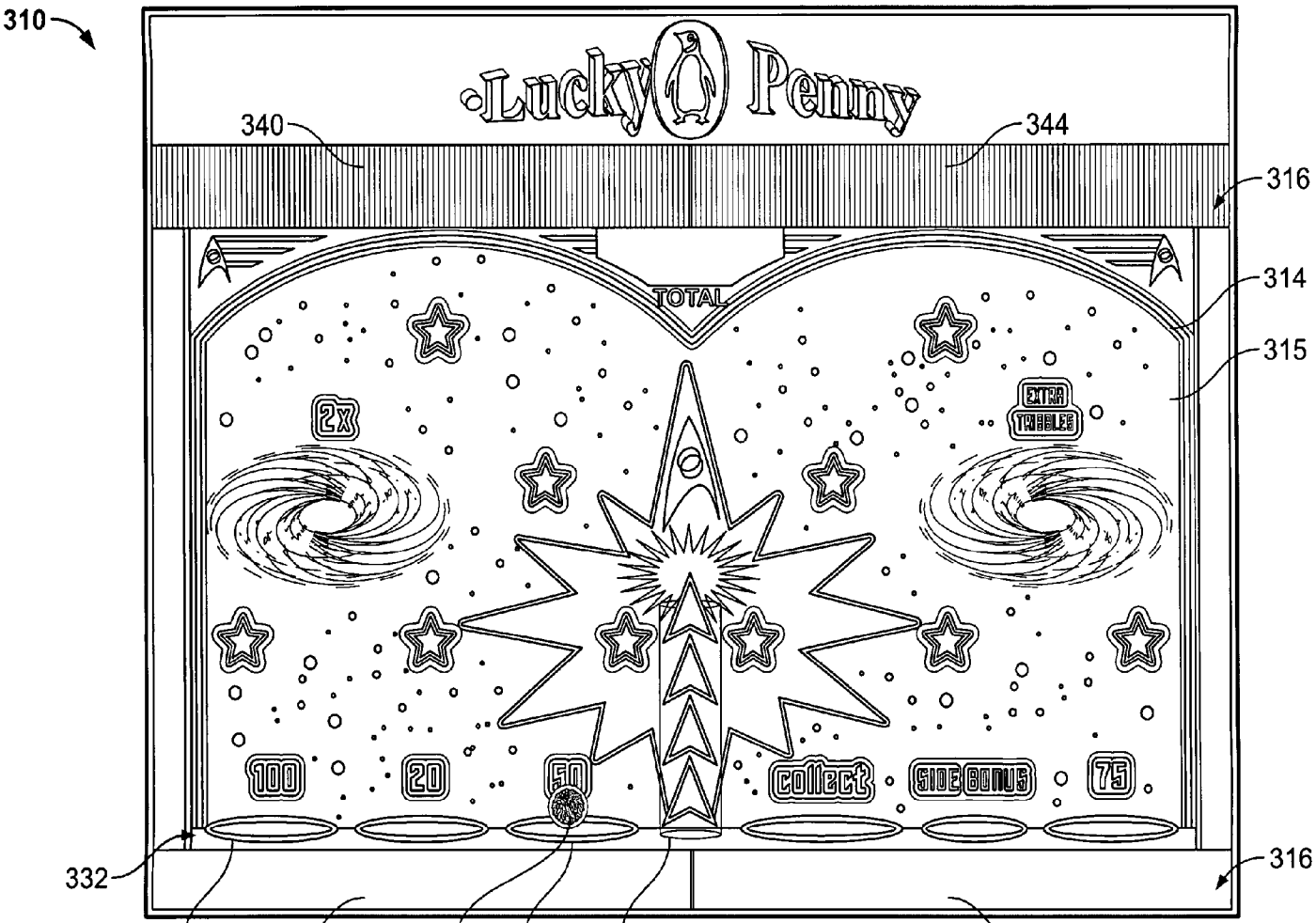
FIG. 6 is a view of the gaming system of FIG. 3, in which a further continuation of play is depicted.

Turning to FIG. 6, when the moveable symbol 365 finally falls to the bottom of the playing field 315 and lands in an award symbol 367, for example, the bottom second and fourth quadrants 342, 346 may be flashed. The second and fourth quadrants 342, 346 adjacent the bottom of the playing field 315 are activated or turned "ON" (no vertical hatch marks) so as to draw a player's attention to the bottom of the playing field 315 where the award 367 is being provided. Thus the flashing of these quadrants 342, 346 enhances any flashing of lights in the playing field 315 that occurs in response to the moveable symbol 365 landing in an award symbol 367. The gaming device 310 may now determine a number of credits to be awarded to the player. In the embodiment shown, the player is awarded a 50 credit award which is associated with the award symbol 367 in which the moveable symbol 365 landed.

Figure 7:
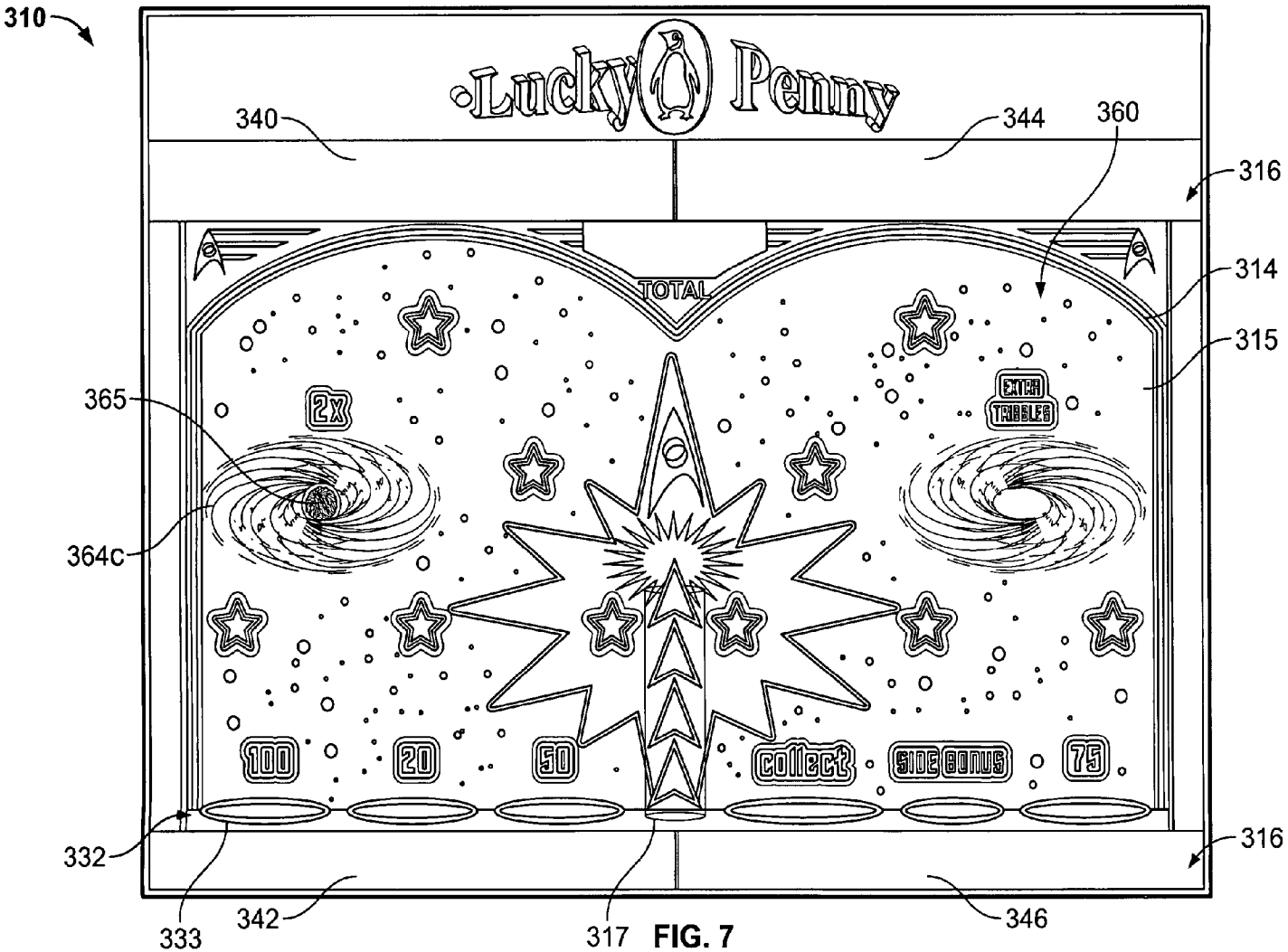
FIG. 7 is a view of the gaming system of FIG. 3, in which another continuation of play is depicted.

Turning to FIG. 7, another play of the wagering game 360 is displayed. During play of the game, the moveable symbol 365 may intersect a fixed symbol 364*c*, which is a "special" award cup. Thus, as seen in FIG. 7, the movable symbol 365 has landed in the special award cup 364*c* which takes the form of a "black hole" which is associated with the outer space theme of the wagering game 360. Then the moveable symbol 365 lands in the award cup 364*c*, it is held there for a period of time to accentuate and emphasize the provision of an award associated with the award cup 364*c*. As seen in FIG. 7, the award cup 364*c* is associated with a "2×" multiplier special award. When the moveable symbol 365 is held by the award cup 364*c*, all four quadrants 340, 342, 344, 346 may be flashed of turned "ON" (no vertical hatch marks), and the gaming device 310 may store the occurrence of this event. The moveable symbol 365 may be held at the location of the fixed symbol 364*a* pending a further event, may be transferred to another location, or may be allowed to continue on its way. In this embodiment of the gaming device 310, the moveable symbol 365 may be briefly held and then released from the fixed symbol 364*c*. By activating and turning on all four quadrants 340, 342, 344, 346, the gaming device 310 emphasizes a "big win" or "special award" associated with the award cup 364*c*. In this way, the bezel light 316 is controlled so as to be turned "ON" in coordination with the events of game play in the playing field 315.

During game play the playing field 315 may have lights or other graphical animations that are displayed on the primary display 314 when certain events occur during game play, for example, when the moveable symbol 365 intersects a fixed symbol 364*a*, 364*b*, 364*c*, 364*d*. Each of the activations or flashes of the respective four quadrants 340, 342, 344, 346 may be synchronized to the animation of the onscreen displays. Each animation of a collision on the display 314 may have a "trigger frame" in it that is used to determine when the quadrants 340, 342, 344, 346 should be respectively flashed. This is to synchronize the quadrant flash with the peak of the onscreen flash, creating the illusion that the quadrants are simply an extension of the onscreen animation. Thus, as the animations of the primary display 314 are stored in memory and recalled for display, the triggering frames within the animation are sensed by one or more controllers, which in turn cause the bezel light 316 and the relevant quadrants 340, 342, 344, 346 thereof to be activated in coordination with the animation on the display 314.

Figure 8:
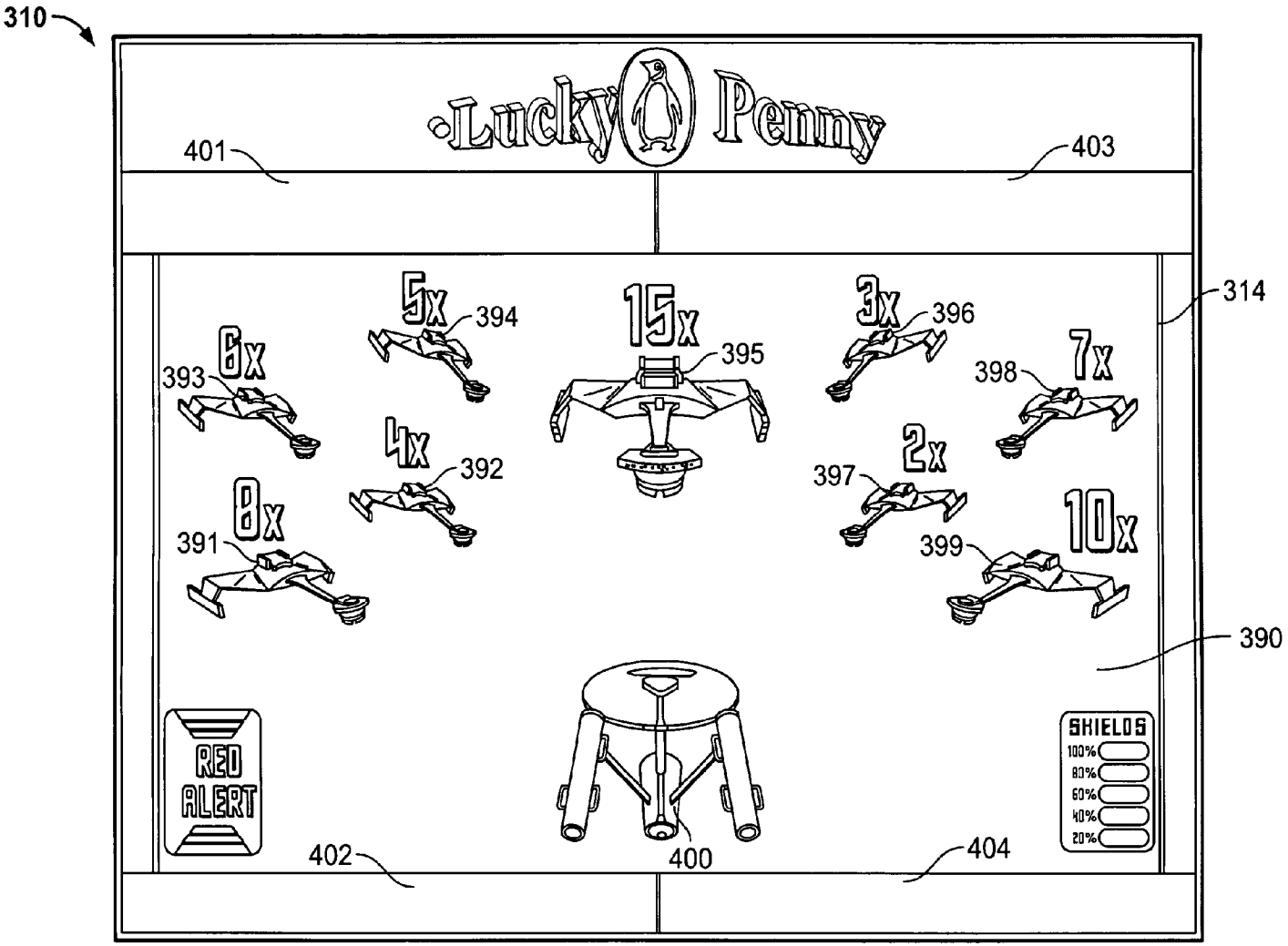
FIG. 8 is a view of a bonus game of the gaming system according to the present method and apparatus.

Turning to FIG. 8, the gaming device 310 may further have a bonus game that may be activated by the occurrence of predetermined events of the playing field 315. For example, the bonus game, "red alert", may be triggered by the player exceeding a predetermined number of award points. Other triggering events may be used as well, including time based triggers, threshold based triggers, and random triggering events. When the bonus game is triggered, a new playing field 390 may replace the playing field 315, or alternatively, the new playing field 390 may be displayed on another portion of the display 314, or alternatively the new playing field 390 may be displayed on a secondary or separate display on the same gaming device 310, a secondary gaming device, or even a separate display such as a handheld display or community display.

The embodiment of the playing field 390 depicted in FIG. 8 comprises an outer space bathe game which includes a plurality of space ships 391, 392, 393, 394, 395, 396, 397, 398, 399 and a player's space ship 400. The "red alert" bonus game may be a battle between the player's space ship 400 and the space ships 391, 392, 393, 394, 395, 396, 397, 398, 399. Each of the space ships 391, 392, 393, 394, 395, 396, 397, 398, 399 may be assigned a respective point value, credit award, multiplier level, or other award or prize.

During game play, the player's space ship 400 shoots at the opponents in an attempt to destroy them and earn prizes. If a ship 391, 392, 393, 394 on the left side of the playing field 390 is hit by a the player's space ship 400, the left quadrants 401, 402 on the left side are flashed, activated or turned "ON". Similarly, if a ship 396, 397, 398, 399 on the right side of the playing field 390 is hit by the player's space ship 400, the right quadrants 403, 404 on the right side are flashed, activated or turned "ON". In an embodiment, if the middle ship 395 is hit by the player's space ship 400, the top two quadrants 401, 403 on the top edge of the playing field 390 are flashed, activated or turned "ON", and if the player's space ship 400 is hit by one or more of the space ships 391, 392, 393, 394, 395, 396, 397, 398, 399, the bottom two quadrants 402, 404 on the bottom edge of the playing field 390 are flashed, activated or turned "ON". Thus, the quadrants 401,402,403,404 are activated in a controlled manner so as to be synchronized with the animation of the game play on the playing field 390, and to direct a player's attention to the portion of the playing field 390 central to the action. The embodiments shown and described are example embodiments, and in alternative embodiments, a large variety of different graphic symbols, animations, game play types, game elements and game scenarios may be employed.

Game play in this embodiment may further have a game activity of replenishing the shields of a space ship. When the shields of a space ship are replenished, all four quadrants 401, 402, 403, 404 may be flashed together or in some predetermined order or pattern. In general, a respective one of the at least first and second moveable symbols may have at least first and second statuses. All of the sections of the bezel lights are activated when the respective moveable symbol undergoes a change of an associated status between the at least first and second statuses. Alternatively, there may be a plurality of statuses, such as different strength levels of the shields of a space ship. A variety of coordinated lighting techniques may be used so as to coordinate activation and deactivation of the bezel lights and sections 401,401,403,404 thereof in concert with the changing statuses of various game elements.

Embodiments of the present method and apparatus may assign the number of flashes and the rate of flashing in different predetermined patterns depending on the design of the game. The features of the present method and apparatus may be used in other settings of games, such as, land battles, sea battles, races, competitions, sporting events, and other contests. In general, embodiments of the present method and apparatus may include games with multiple players. Furthermore, embodiments of the present method and apparatus may function as a bonus game in a primary wagering game. Thus, the coordinated bezel lighting may be used in conjunction with a secondary display displaying a bonus game, in conjunction with a primary display displaying a primary wagering game, or both. Virtually any form of display used within a gaming system (primary display, secondary display, handheld display, community display, etc.) may be outfitted with surrounding bezel lights and quadrants which are configured so as to be activated and deactivated in concert and in coordination with the animations, graphics, and game play displayed on such displays.

Primary wagering games may be configured in a large variety of manners so as to take advantage of the playing field. For example, the wagering game may be a single player wagering game in which random outcomes of the primary wagering game generate game attributes which interact with the field attributes of the playing field so as to navigate a player through the playing field in an attempt to reach a variety of goals, prizes, awards, etc. In another embodiment, the player may play against a computer character who is attempting to reach or collect the same goals, prizes or awards (or different ones). Many multi-player configurations may be utilized such as the competitive and collaborative examples described herein. Players may be organized in various groups or teams, and then the teams may be permitted to play in competitions against one another.

Various themes and configurations may be utilized with the playing field and primary wagering game to provide many variations of wagering game experiences. In one embodiment, the wagering games may be configured such that the playing field is a competition between pirate ships which are sailing and firing weaponry at one another in an effort to defeat the other. The primary wagering game outcomes may generate game attributes such as a variety of weapons, types of offensive attacks, and speed and direction of the ship.

Players may be given options as to when and where to start play of the secondary or primary wagering games, or both. For example, players may receive a "restart" option so as to restart or reset the playing field and begin interacting with a new "board" or "field." Moreover, players may be permitted to select from a plurality of available playing fields, so as to customize their gaming experience. In other embodiments, a playing field may be further subdivided into levels, tiers, stages, or zones. For example, a player may participate on a certain level, stage or episode, until certain criteria are satisfied (completing the stage, collecting a certain amount of credits, striking out, etc.). Then the player may be permitted to move on to a different level, stage or episode. In other embodiments, a playing field may be divided into zones. Different rule sets may apply to different zones, such that play in each zone is unique. Moreover, the playing field attributes in each zone may be different.

Moreover, the themes of the games may include board games such Monopoly™, Battleship™, Sudoku, etc. In such a configuration, the playing field may include a visual display of the board relevant to the game theme. The primary wagering games of the system may generate outcomes including game assets which allow players to traverse the board, and interact with the playing field. The "board" may include spaces with instructions and actions which a player may or must undertake. Such spaces and instructions comprise field attributes of the playing field. Other thematic configurations may include any form of team play, collaboration, competition, or solo play.

It should be understood that the symbols of the primary wagering game having game attributes associated therewith may be the entire primary wagering game, or may be only a portion thereof. For example, the primary wagering game may generate symbols and game attributes on every play. In another embodiment, the primary wagering game may generate game attributes only on certain plays of the game, for example during a free spin event or a tournament. Moreover, the symbols of the reels, in addition to generating game attributes, may also generate winning combinations for which awards are paid in accordance with one or more pay tables of the system.

Although the embodiments depicted herein are directed to a pinball type game, the game play on the screen may really be any type of game play. For example, the game play could be a regular slot game where certain events are emphasized with the coordinated bezel lights. For example, a big win (Cherry Cherry Cherry, e.g.) could be emphasized with all red bezel lighting. Depending on the type of game play, the bezel lights may be turned on and off individually, may be turned on and off in various combinations, may be flashed with different rates and in different patterns. Moreover, a variety of colors may be utilized on the bezel lighting and controlled in various manners. For example, certain colors may be utilized to signify certain types of gaming events, while other colors are used to signify other gaming events. Lighting patterns may also be utilized in controlled fashion to signify the occurrence of various events. For example, the various quadrants of the bezel light may be activated in one order or pattern to signify a first gaming event or outcome, and in a second order or pattern to signify a second gaming event or outcome.

A variety of triggering events may cause a bonus game event to commence such that the game attributes collected are used, played, or interact with the playing field. In some embodiments, the triggering event may be the collection of a predetermined set of game attributes. In other embodiments, the triggering event may be a randomly generated event. In yet other embodiments, eligibility rules may apply which are the same as or distinct from the triggering event. The eligibility rules may govern which players, if any, are permitted to participate in the secondary event. For example, a player may only be permitted to participate in the secondary event if he has placed a maximum wager on the primary wagering game. In another embodiment, the eligibility rules may require a player to have collected one or more of each type of available game attribute in order to play the bonus game.

Each of these embodiments and obvious variations thereof is contemplated as falling within the spirit and scope of the claimed invention, which is set forth in the following claims.

What is claimed is:

1. A gaming system comprising:

at least one video display device for displaying a wagering game including a playing field having a left side and a right side, and further displaying at least one moveable game element and one or more other game elements;

a plurality of bezel lights positioned proximate the display device, the plurality including a left side set of bezel lights adjacent to the left side of the playing field and a right side set of bezel lights adjacent to the right side of the playing field; the plurality of bezel lights being distinguishable from the one or more other game elements;

one or more processors; and at least one memory device storing instructions that, when executed by the one or more processors, cause the one or more processors to operate with the at least one display device and the plurality of bezel lights to activate the left side set in response to the at least one moveable game element impinging upon at least one of the one or more other game elements on the left side of the playing field; and activate the right side set in response to the at least one moveable symbol impinging upon at least one of the one or more other game elements on the right side of the playing field.

2. The gaming system according to claim 1, further comprising at least one sound output device, and wherein the at least one sound output device is activated in coordination with the activation of one or more bezel lights of the plurality.

3. The gaming system according to claim 1, wherein the one or more processors operate to further activate the bezel lights of the plurality, singly or in combination, in coordination with movement of the at least one moveable game element.

4. The gaming system according to claim 1, wherein one or more the lights of the plurality of bezel lights are positioned in quadrants relative to the display device.

5. A computer-implemented method of operating a wagering game including a playing field having a left side and a right side, the wagering game displayed on a first video display device having a plurality of bezel lights including a left side set of lights adjacent to the left side of the playing field and a right side set of light adjacent to the right side of the playing field, the method comprising:

displaying, on the first video display device, at least one moveable game element and one or more other game elements;

activating the left side set in response to the at least one moveable game element intersecting at least one of the one or more other game elements on the left side of the playing field; and activating the right side set in response to the at least one moveable game element intersecting at least one of the one or more other game elements on the right side of the playing field, the plurality of bezel lights being distinguishable from the one or more other game elements.

6. The method according to claim 5, further comprising activating, in coordination with activating one or more bezel lights of the plurality, at least a sound output device.

7. The method according to claim 5, wherein one or more bezel lights of the plurality are further activated, singly or in combination, in coordination with movement of the at least one moveable game element.

8. The method according to claim 5, wherein one or more bezel lights of the plurality of bezel lights are positioned proximate the first display at predetermined positions relative to the display device, and wherein the one or more bezel lights are selectively activated singly or in combination as a function of the predetermined positions of the one or more bezel lights and of a current position of the at least one moveable game element.

9. The method according to claim 5, wherein one or more bezel lights of the plurality of bezel lights are respectively positioned in quadrants relative to the display device.

10. The method according to claim 5, wherein the plurality of bezel lights further comprises a plurality of subsections, each of the subsections capable of activation and deactivation independently of each of the remaining subsections.

11. A gaming system comprising:

at least one video display device for displaying a primary wagering game, the primary wagering game including a playing field having a left side and a right side, and further displaying at least one substantially fixed symbol, at least one moveable symbol, and at least one award symbol;

a plurality of bezel lights arranged in sections including a left side set of sections adjacent the left side of the playing field and a right side set of sections adjacent the right side of the playing field, and respectively positioned proximate the display device;

one or more processors; and at least one memory device storing instructions that, when executed by the one or more processors, cause the one or more processors to operate with the at least one video display device and the plurality of bezel lights to selectively activate the left side set in response to the at least one moveable symbol intersecting one of the at least one fixed symbol and the at least one award symbol, wherein at least one of the intersected symbols is on the left side of the playing field; and selectively activate the right side set in response to the at least one moveable symbol intersecting one of the at least one fixed symbol and the at least one award symbol, wherein at least one of the intersected symbols is on the right side of the playing field.

12. The gaming system of claim 11, wherein the plurality of bezel lights are each a subsection of a singular bezel light.

13. The gaming system of claim 11, further comprising the at least one fixed symbol being a special symbol, and wherein all sections of the bezel lights are substantially simultaneously activated in a predetermined pattern when the moveable symbol intersects the special symbol.

14. The gaming system of claim 11, wherein the playing field further includes at least one animation that is activated when the at least one moveable symbol intersects one of the at least one fixed symbol and the at least one award symbol, and wherein the sections of bezel lights are additionally activated in different patterns and combinations as a function of the moveable symbol intersecting different fixed symbols and award symbols in a predetermined coordinated pattern with the at least one animation.

15. The gaming system of claim 11, wherein the at least one fixed symbol includes a left side set of fixed symbols on the left side of the playing field and a right side set of fixed symbols on the right side of the playing field, wherein the left side set of sections is activated in response to the moveable symbol intersecting a fixed symbol of the left side set of fixed symbols, and wherein the right side set of sections is activated in response to the moveable symbol intersecting a fixed symbol of the right side set of fixed symbols.

16. The gaming system of claim 11, wherein the instructions cause the one or more processors to provide at least one award in accordance with a pay table based on the moveable symbol intersecting the at least one award symbol.

17. The gaming system of claim 11, wherein the instructions cause the one or more processors to display, in response to a triggering event, a bonus game, wherein the bonus game has a playing field with at least first and second moveable bonus symbols that interact, and wherein the sections of the bezel lights are activated in different patterns and combinations as a function of the interaction of the at least first and second moveable bonus symbols.

18. The gaming system of claim 17, wherein one of the at least first and second moveable symbols has at least a first status and a second status, and wherein at least one of the sections of bezel lights is activated when the one of the at least first and second moveable symbols undergoes a change between the at least first and second status.

* * * * *